US006116973A

United States Patent [19]

Higby

[11] Patent Number: 6,116,973

[45] Date of Patent: Sep. 12, 2000

[54] APPARATUS AND METHODS FOR PREVENTING RELATIVE SIDE TO SIDE MOTION BETWEEN A PROPSHAFT HOUSING AND A GEAR CASE

[75] Inventor: Jeffrey P. Higby, Grayslake, Ill.

[73] Assignee: Outboard Marine Corporation, Waukegan, Ill.

[21] Appl. No.: 09/267,740

[22] Filed: Mar. 15, 1999

[51] Int. Cl.[7] ..... B63H 20/32

[52] U.S. Cl. ..... 440/78; 440/900

[58] Field of Search ..... 416/244 R, 244 B; 440/49, 76, 77, 78, 79, 83, 900

[56] References Cited

U.S. PATENT DOCUMENTS 4,923,417 5/1990 Onoue ..... 440/78

4,948,384 8/1990 Bland et al. ..... 440/78

*Primary Examiner*—Stephen Avila

*Attorney, Agent, or Firm*—Armstrong Teasdale LLP

[57] ABSTRACT

A wedge for preventing relative side to side motion between the propshaft housing and the gear case of an outboard engine is described. The wedge is configured to be located between the propshaft housing and the gear case bore inner diameter surface so that the wedge forces one side of the propshaft housing into contact with the bore surface. The wedge fills, or bridges, the clearance gap between the propshaft housing and the gear case bore surface at the location of the wedge.

33 Claims, 4 Drawing Sheets

APPARATUS AND METHODS FOR PREVENTING RELATIVE SIDE TO SIDE MOTION BETWEEN A PROPSHAFT HOUSING AND A GEAR CASE

BACKGROUND OF THE INVENTION

The invention relates generally to propshaft housings for outboard engines, and more particularly, to preventing relative side to side motion between the propshaft housing and the gear case.

Known outboard engines include a drive shaft which extends from the engine power head, through an exhaust case, and into an engine lower unit. The lower unit includes a gear case, and a propeller shaft extends through the gear case. A pinion gear affixed to the lower end of the drive shaft meshes with and drives two gears diametrically opposed to each other and rotationally aligned with the propeller shaft. A clutching member, which is slidingly connected to the propeller shaft, selectively engages one of the drive gears, thereby driving the propeller shaft in the same rotational direction as the engaged gear. One propeller shaft rotational direction provides forward thrust, and the other rotational direction provides reverse thrust. The rotational axis of the propeller shaft is generally perpendicular to the rotational axis of the drive shaft.

A bearing housing, sometimes referred to as a propshaft housing, is located within the gear case, and the propeller shaft extends through a longitudinal bore in the propshaft housing. Bearings are supported within the propshaft housing bore, and the propeller shaft rotates relative to the propshaft housing on the bearings.

Due to the significant vibrations and power transmitted by the propeller shaft, the propshaft housing must be tightly secured to the gear case to prevent relative motion between the propshaft housing and the gear case. Such relative motion causes wear, which leads to increased clearances between the housing and the gear case. Increased clearances permit greater relative motion, and therefore greater wear, which can result in failure of the gear case, the propshaft housing, the propeller shaft, gears, and/or other components. The propshaft housing must also be removable from the gear case to permit repair and/or replacement of internal components.

Known apparatus attempt to at least limit relative axial, rotational, and lateral movement between the propshaft housing and the gear case. For example, one or more threaded fasteners can be used to limit relative axial motion through a clamping action, and the clamping action also limits relative lateral motion. Lateral movement can only be eliminated, however, by eliminating the clearances between the gear case and the propshaft housing. Also, to limit relative lateral movement, one or more O-rings may be located between the outside diameter of the propshaft housing and inside the bore of the gear case to act as shock absorbers. Due to the elasticity of o-rings, relative lateral motion is reduced, but not eliminated.

Another known retention apparatus for securing a propshaft housing to a gear case includes steel tabs that are tightened against the rear face of the propshaft housing, and the ends of the tabs project radially outward from the outside diameter of the propshaft housing into recesses in the gear case bore. The tab thickness is slightly larger than the distance between the face of the propshaft housing and the rear face of the gear case recess, and the tabs bend slightly when fully tightened against the propshaft housing as the front end of the housing contacts a shoulder in the gear case.

This bending of the tabs, which is within the elastic limit of the steel, maintains a high axial load on the propshaft housing against the gear case shoulder, which generates enough friction to prevent rotation of the propshaft housing relative to the gear case. The friction between the tabs, the propshaft housing, and gear case recesses does not, however, always prevent relative lateral movement. The ensuing wear tends to loosen the axial clamp load, which then permits relative rotational movement as well.

In other known engines, threads are formed at the propeller end of the gear case, and after locating the propshaft housing within the gear case, a collar is threadedly secured to the gear case and tightly fits against the propshaft housing. The frictional contact between the propshaft housing and the gear case shoulder, and between the propshaft housing and the collar, effectively prevents rotational and lateral movement of the housing relative to the gear case. To prevent loosening of the collar, a thin washer with an outwardly projecting radial tab and an inwardly projecting radial tab is located between the threaded ring and the propshaft housing. The outer tab fits into a slot in the gear case, and the inner tab is folded over into one of the slots on the inside diameter of the threaded collar. Corrosion and marine growth, however, may make removal of the collar extremely difficult, if not impossible, when servicing is required. In addition, the large exposed threads on both the collar and the gear case can be easily damaged and are relatively expensive to manufacture.

In some other known engines, the propshaft housing includes flanges at the housing aft end, and bolts extend through openings in the flanges and engage the gear case, which totally eliminates rotation of the propshaft housing relative to the gear case. The flanges are tightened against the gear case, which securely positions the propshaft housing axially with respect to the gear case. Although securing the propshaft housing to the gear case in this manner effectively eliminates all relative motion between the aft end of the propshaft housing and the gear case, there may be undesirable hydrodynamic consequences of the flange configuration. The propshaft flange arrangement, therefore, is typically only used for low speed applications, i.e., on small horsepower engines.

Another known retention apparatus employs one or more snap rings expanded into a groove or grooves in the gear case bore at the front end of the propshaft housing, and an annular plate is positioned in front of the snap rings. The plate has two or more threaded holes into which screws are tightened after passing through the front face of the propshaft housing. The snap rings are tightly trapped between the plate and the housing. The snap rings provide an axial locating feature, while the friction between the plate, rings, and housing tends to prevent lateral and rotational movement of the housing relative to the gear case. Unfortunately, the prevention of relative lateral movement occurs only at the front of the propshaft housing. Lateral movement at the rear end of the propshaft housing is not reduced or eliminated, and excessive wear can progress quite rapidly. Also, the holes in the propshaft housing through which the screws pass must be sealed to prevent leakage of water into the gear case. Sealing the openings can be tedious and time consuming.

It would be desirable to provide a propshaft housing retention arrangement that tightly secures the propshaft housing to the gear case so as to eliminate relative side to side movement between the propshaft housing and the gear case, especially in high performance engines. It also would be desirable to provide such an arrangement that enables easy removal of the propshaft housing from the gear case.

BRIEF SUMMARY OF THE INVENTION

These and other objects may be attained by a wedge configured to be located between the propshaft housing and the gear case bore inner diameter surface. The wedge forces one side of the propshaft housing into contact with the gear case bore surface. The wedge also fills, or bridges, the clearance gap between the propshaft housing and the gear case bore surface at the location of the wedge.

While known propshaft retention apparatus rely on friction induced by one or more threaded fasteners to limit side to side movement of the propshaft housing within the clearance gap between the propshaft housing and the gear case, the wedge prevents relative side to side motion by eliminating the clearance gap. Particularly, one side of the propshaft housing is in tight contact with the gear case, and the opposing side of the housing is in tight contact with the wedge. The wedge completely fills, or bridges, the clearance gap between the propshaft housing and the gear case. The wedge also ensures that the gap is completely bridged regardless of the diametral tolerances.

DETAILED DESCRIPTION OF THE INVENTION

The present propshaft housing configuration is illustrated and described below in the context of a high performance outboard engine. While the propshaft housing configuration is believed to provide significant benefits for such engines, the configuration is not limited to use in such high performance outboard engines. For example, the propshaft housing could be used in connection with more common outboard engines as well as with stern drive units. Therefore, it should be understood that the propshaft housing configuration is not limited to practice with just high performance outboard engines.

In addition, the term "wedge" as used herein is not limited to only a wedge shaped component. Rather, as used herein, the term wedge refers to a component of any shape that fits in the clearance gap between the propshaft housing and the gear case to reduce, if not eliminate, relative side to side motion between the propshaft housing and the gear case. As herein described, the wedge is a single piece of relatively small arc length. It should be understood, however, that more than one wedge could be employed, as could wedges with much larger arc lengths, including a wedge that forms a complete circle and completely fills, or bridges, the entire gap between the propshaft housing and the gear case.

Figure 1:
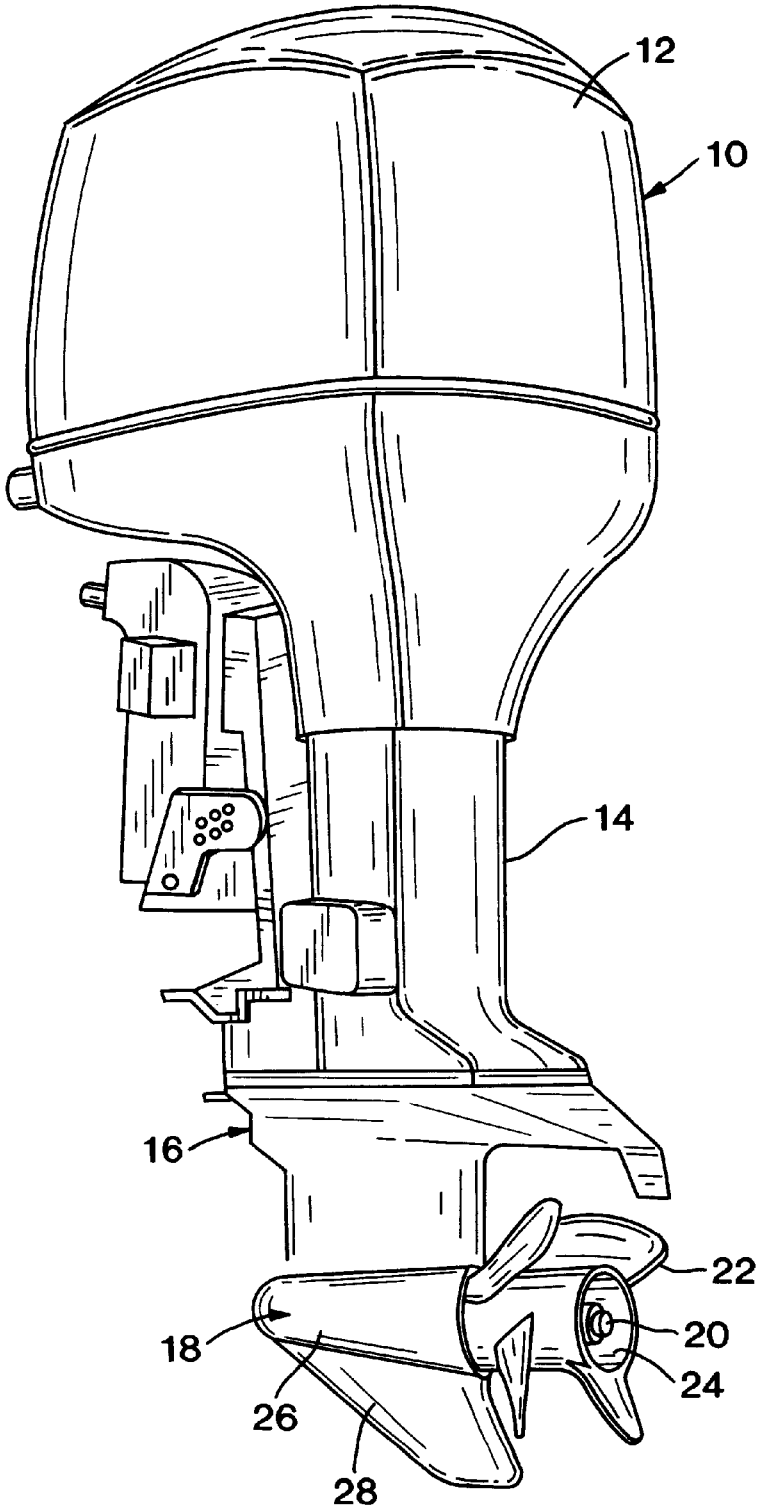
FIG. 1 is a perspective view of an outboard engine.

Referring now particularly to the drawings, FIG. 1 is a perspective view of an outboard engine, such as a high performance 250 horsepower V6 Evinrude® outboard engine commercially available from Outboard Marine Corporation, Waukegan, Ill. Engine 10 includes a cover 12 which houses a power head (not shown), an exhaust housing 14, and a lower unit 16.

Lower unit 16 includes a gear case 18 which supports a propeller shaft 20. A propeller 22 is engaged to shaft 20. Propeller 22 includes an outer hub 24 through which exhaust gas is discharged. Gear case 18 includes a bullet, or torpedo, 26 and a skeg 28 which depends vertically downwardly from torpedo 26.

Figure 2:
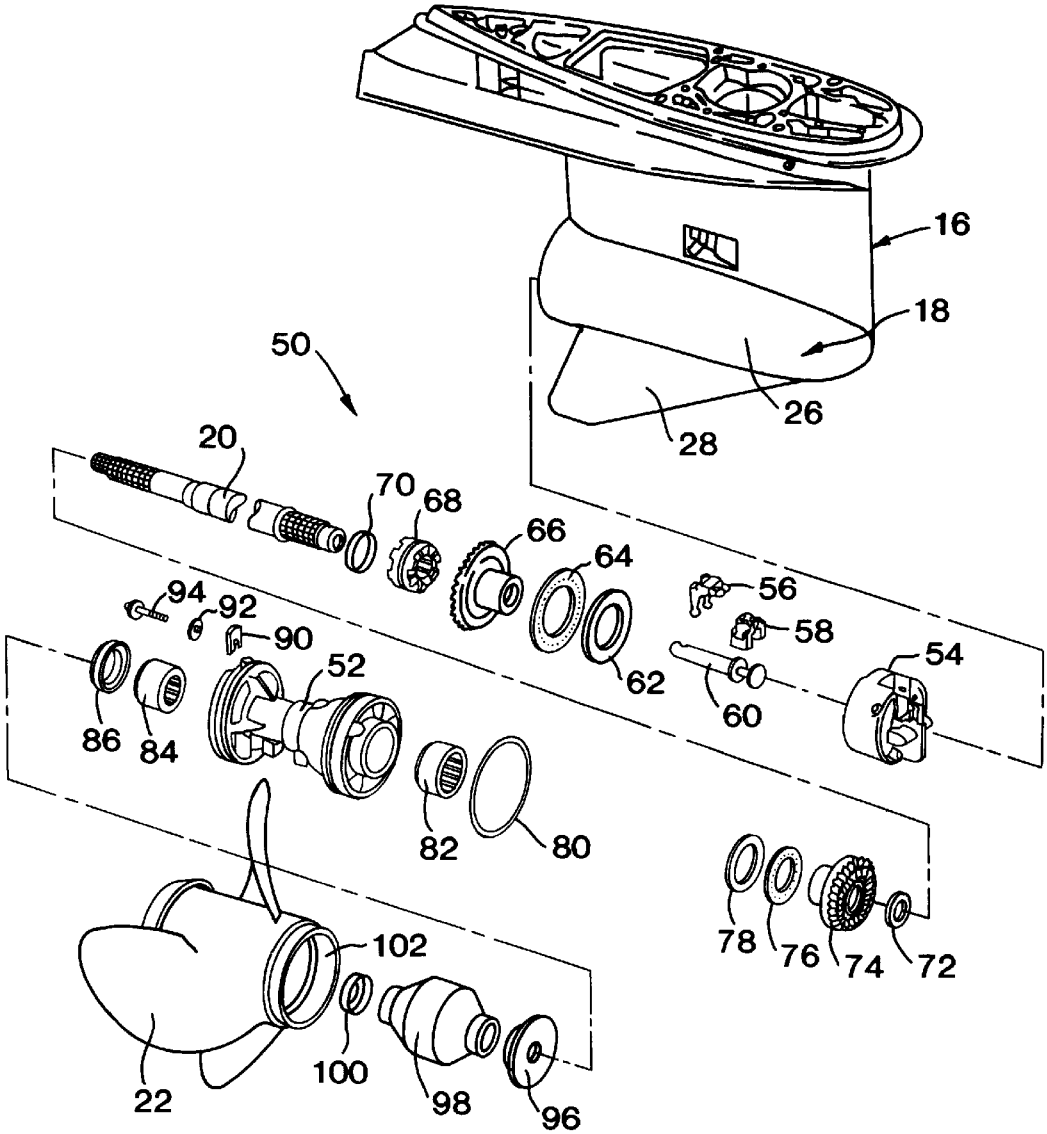
FIG. 2 is an exploded view of a lower unit and propeller shaft assembly.

FIG. 2 is an exploded view of lower unit 16 and a propeller shaft assembly 50. Although components not shown in FIG. 2 typically are included in assembly 50, as is well known in the art, the components illustrated in FIG. 2 are shown by way of example only to illustrate the position of a propshaft housing 52. Assembly 50 includes a housing and bearing assembly 54, and a shift lever 56, a shifter cradle 58, and a shaft 60. Assembly 50 also includes a forward gear thrust washer 62, a forward gear thrust bearing 64, a forward gear 66, a shifter 68, and a spring 70. Assembled at the other end of shaft 20 is a propshaft thrust ring 72, a reverse gear 74, a reverse gear thrust bearing 76, and a reverse gear thrust washer 78.

An o-ring 80 and a bearing 82 are assembled at one end of propshaft housing 52, and a bearing 84, and a seal 86 are assembled at the other end of housing 52. Retainer tabs 90 are secured to propshaft housing 52 by washers 92 and bolts 94. Tab 90 extends into a groove formed in the inner surface of the gear case bore.

A thrust bushing 96, a bushing assembly 98, and a sleeve 100 are positioned to be located within propeller bore 102. Propeller shaft 20 extends through propshaft housing 52 and into propeller bore 102 so that propeller 22 can be secured thereto.

Generally, assembly 50 is located within gear case 18, except, of course, propeller 22. Gears 66 and 74 are meshed with and rotationally driven in opposite directions by a pinion gear, which is tightly secured to the drive shaft, which is rotationally driven by the engine. Shifter 68 engages propeller shaft 20 through splines, and can be forced to slide along the splines by operator controlled linkage (not shown). Lugs projecting from each end of shifter 68 selectively engage mating lugs projecting from the face of each gear 66 and 74, thereby causing propeller shaft 20 and propeller 22 to rotate in the desired direction.

In one aspect, the present invention is directed to preventing relative side to side motion between propshaft housing 52 and gear case 18. Generally, and to prevent such relative side to side movement, a wedge is located between the inside diameter of the gear case bore and a ramped surface on the outside diameter of propshaft housing 52. The wedge forces propshaft housing 52 against the opposing side of the gear case bore and tightly fits between housing 52 and gear case 18, which prevents any relative side to side motion between propshaft housing 52 and the bore.

As explained above, the term "wedge" as used herein is not limited to only a wedge-shaped component. Rather, as used herein, the term wedge refers to a component of any shape that fits in the clearance gap between the propshaft housing and the gear case to eliminate relative side to side motion between the propshaft housing and the gear case.

Figure 3:
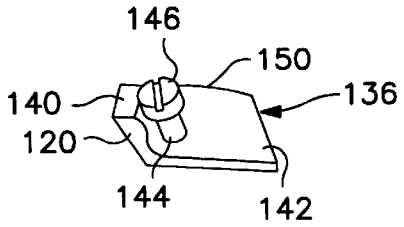
FIG. 3 is an exploded view of a propshaft housing partially located within a gear case.
Figure 3:
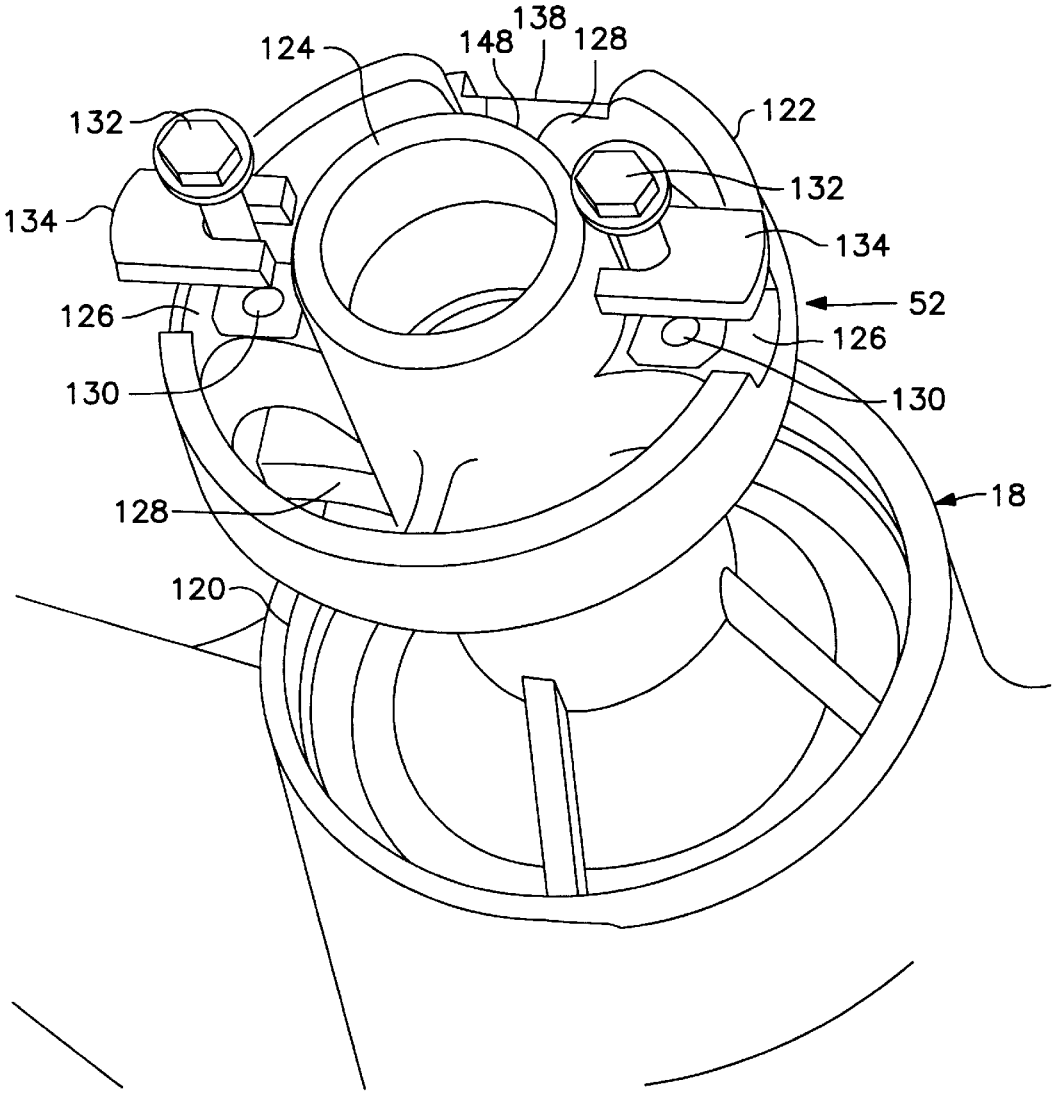

More particularly, FIG. 3 is an exploded view of propshaft housing 52 partially located within a gear case bore 120. Propshaft housing 52 includes an aft positioning ring 122 secured to a central cylindrically shaped member 124 by webs 126 and 128. Opposing webs 126 have threaded openings 130 therein for receiving bolts 132. Propshaft housing retention tabs 134 are secured to propshaft housing 52 by bolts 132, and as described below in more detail, such tabs 134 facilitate preventing some, but not all, relative movement between propshaft housing 52 and bore 120. Tabs 134 are known in the art.

In accordance with the present invention, a wedge 136 is sized to be located between an inside diameter of gear case bore 120 and a ramped surface 138 on an outside diameter of ring 122. Wedge 136 has a flange 140 which extends perpendicular to an outside arc surface 142 of wedge 136. An opening 144 in flange 140 is sized so that a bolt 146 can extend therethrough and into a threaded opening 148 in ring 122. A spring washer 150 maintains a constant force between bolt 146 and wedge 136.

Figure 4:
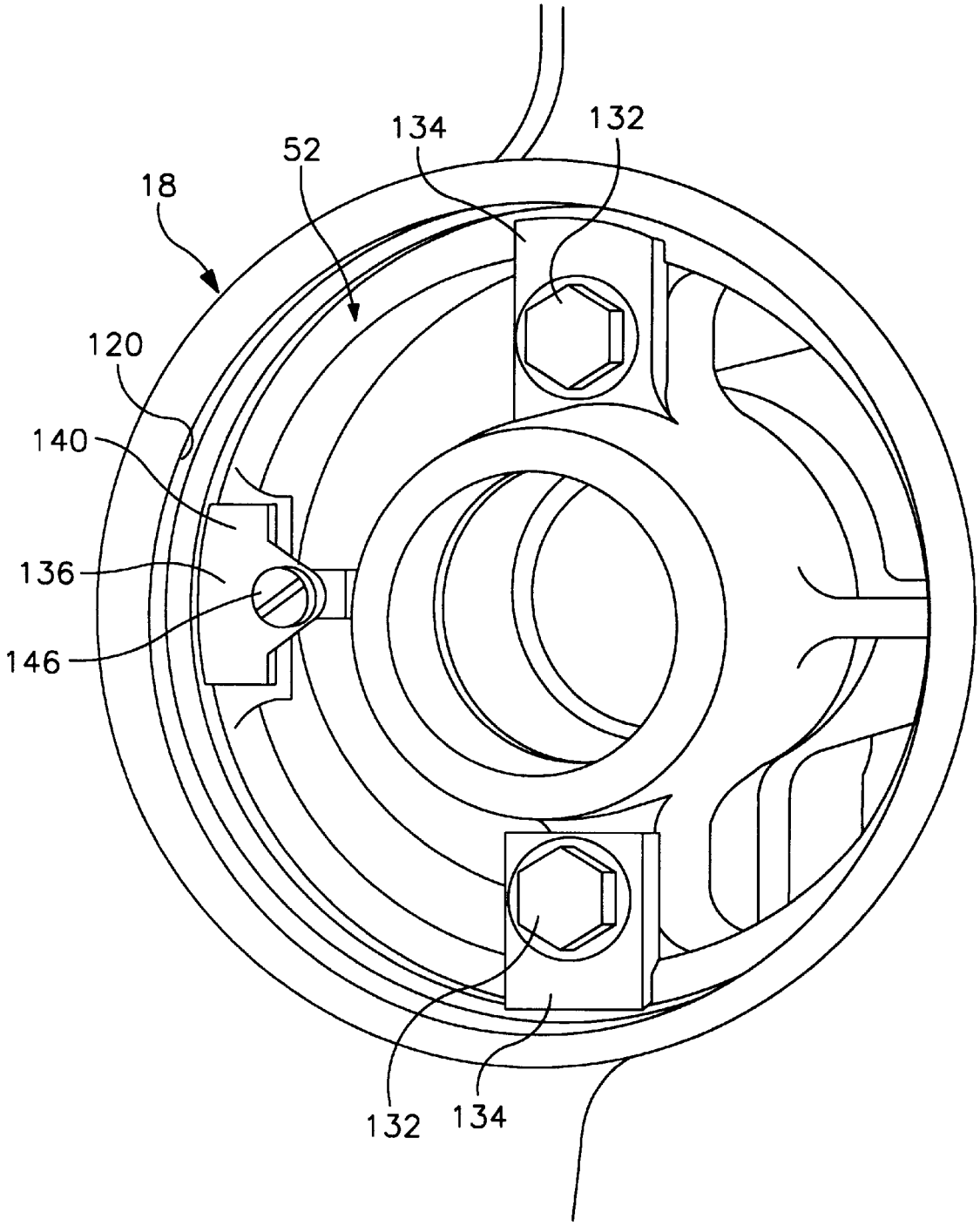
FIG. 4 is an enlarged view of the propshaft housing shown in FIG. 3 and fully secured to the gear case.

Referring to both FIGS. 3 and 4, and to assemble wedge 136 and propshaft housing 52 in gear case 18, prior to tightening bolt 146 to secure wedge 136, retention tabs 134 are secured to housing 52 by bolts 132, which properly positions housing 52 axially tight against a shoulder in gear case bore 120. Tabs 134 effectively prevent fore and aft, as well as up and down motion of propshaft housing 52 relative to gear case 18. Tabs 134 do not, however, prevent side to side motion under all operating conditions.

Wedge 136 is then tightly secured between the inside diameter of gear case bore 120 and ramped surface 138. The sideways force generated by tightening wedge 136 is sufficient to move propshaft housing 52 sideways by overcoming the frictional force between tabs 134 and gear case 18 and/or propshaft housing 52. Properly tightening wedge 136 forces the side of propshaft housing 52 opposite the wedge into direct contact with gear case bore 120, while wedge 136 completely fills the gap between the ramped surface 138 on ring 122 and gear case bore 120.

Figure 5:
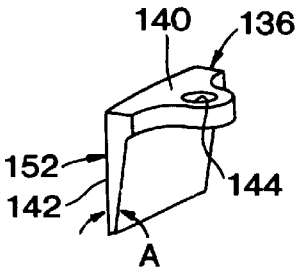
FIG. 5 is a right side perspective view of a wedge for preventing side to side motion between the propshaft housing and the gear case bore.
Figure 6:
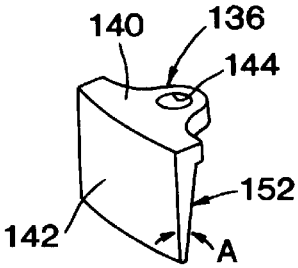
FIG. 6 is a left side perspective view of the wedge shown in FIG. 5.
Figure 7:
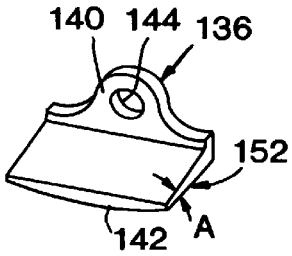
FIG. 7 is an end perspective view of the wedge shown in FIGS. 5.

FIGS. 5, 6 and 7 are right side, left side, and end perspective views of wedge 136. Wedge 136 includes a wedge portion 152 and flange 140. Opening in flange 140 is provided so that bolt 146 can extend therethrough to engage wedge 136 to propshaft housing 52. The angle A of wedge portion should be selected so as to not generate too large an outward hoop stress on the gear case. An exemplary angle A that has been found suitable in one application is 10 degrees, which is large enough to keep the hoop stress low while being small enough to lock itself in place. An angle less than approximately 16 degrees will result in wedge 136 remaining in position once tightened, even if screw is removed or becomes loose. The 10 degree angle also fits within a design envelope for the particular engine, which requires that the exhaust flow not be further restricted. Ramped surface 138 in housing 52 has an angle that matches angle A of wedge 136.

Wedge 136, in one embodiment, is fabricated from stainless steel. More particularly, wedge is molded using stainless steel in powdered form and then sintered for hardening. Alternatively, wedge 136 could be fabricated using nylon with a high glass content, aluminum, brass, or some other suitable material.

Known propshaft retention apparatus rely entirely on friction induced by one or more threaded fasteners to limit movement within the clearance between the propshaft housing and the gear case. Wedge 136 prevents relative motion by eliminating the clearance. The clearance is eliminated because wedge 136 forces propshaft housing 52 tight against one side of gear case bore 120 and fills the clearance gap on the other side of housing 52. Wedge 136 also ensures that the gap is completely bridged regardless of the diametral tolerances.

As described, a single wedge is utilized, however, multiple wedges could be used, as well as one or more wedges with large arc lengths. Two diametrically opposed wedges could permit larger manufacturing tolerances, while still ensuring proper centering in the gear case bore. Also, multiple wedges that are not diametrically opposed could be used. This wedge system does not require any changes to the gear case, so it is possible to improve existing customer units by replacing the propshaft housing with one designed for the wedge, and, of course, adding a wedge. The wedge and/or propshaft housing could be packaged in kit form so that in the event that a wedge is to be added to an existing engine, or a wedge requires repair or replacement, the wedge itself could be purchased for use.

From the preceding description of various embodiments of the present invention, it is evident that the objectives of the invention are attained. Although the invention has been described and illustrated in detail, it is to be clearly understood that the same is intended by way of illustration and example only and is not to be taken by way of limitation. Accordingly, the spirit and scope of the invention are to be limited only by the terms of the appended claims.

What is claimed is:

1. A propshaft housing assembly for being secured within a gear case of an engine, the gear case including a bore, said assembly comprising:

a propshaft housing comprising a center cylindrical shaped member, and a positioning ring secured to said center member by a plurality of webs, said ring having an outer diameter less than an inner diameter of the gear case bore; and a wedge for being secured to said propshaft housing and comprising a first portion configured to extend between said propshaft housing and an inner surface of the gear case bore and a second portion extending substantially perpendicular to said inner surface of the gear case bore.

2. A propshaft housing assembly in accordance with claim 1 wherein said positioning ring comprises a ramped surface, and said wedge is secured to said positioning ring at said ramped surface.

3. A propshaft housing assembly in accordance with claim 2 wherein one of said webs extends radially from said center member to said positioned ring at said ramped surface.

4. A propshaft housing assembly in accordance with claim 1 further comprising at least one retention tab for being secured to said propshaft housing and configured to engage a surface of said gear case to limit movement of said propshaft housing.

5. A propshaft housing assembly in accordance with claim 1 further comprising at least two retention tabs for being secured to opposing webs of said propshaft housing and configured to engage a surface of said gear case to limit movement of said propshaft housing.

6. A propshaft housing assembly in accordance with claim 1 wherein said wedge comprises a flange and a wedge portion.

7. A propshaft housing assembly in accordance with claim 6 wherein said wedge portion comprises surfaces extending from each other at a selected angle A.

8. A propshaft housing assembly in accordance with claim 7 wherein angle A is in a range between about 10 degrees to 16 degrees.

9. A propshaft housing assembly in accordance with claim 1 wherein said wedge is fabricated from at least one of stainless steel, nylon, brass, and aluminum.

10. A propshaft housing assembly in accordance with claim 1 further comprising another wedge for being secured to said positioning ring at one of said other webs.

11. A kit for an engine including a gear case having a bore extending at least partially therethrough and a propshaft housing located in said bore, said kit comprising a wedge for being secured to the propshaft housing and comprising a first portion configured to extend between the propshaft housing and an inner surface of the gear case bore and a second portion extending substantially perpendicular to said inner surface of the gear case bore.

12. A kit in accordance with claim 11 further comprising at least one retention tab for being secured to the propshaft housing and configured to engage a surface of the gear case.

13. A kit in accordance with claim 11 wherein said wedge comprises a flange and a wedge portion.

14. A kit in accordance with claim 13 wherein said wedge portion comprises surfaces extending from each other at a selected angle A.

15. A kit in accordance with claim 14 wherein angle A is in a range between about 10 degrees to 16 degrees.

16. A kit in accordance with claim 11 wherein said wedge is fabricated from at least one of stainless steel, nylon, brass, and aluminum.

17. A wedge for securing a propshaft housing within a bore of a gear case to substantially prevent side to side movement of the propshaft housing relative to the gear case bore, said wedge comprising a wedge portion having an arc surface and a flange portion extending substantially perpendicular to said arc surface.

18. A wedge in accordance with claim 17 wherein said wedge portion comprises surfaces extending from each other at a selected angle A.

19. A wedge in accordance with claim 18 wherein angle A is in a range between about 10 degrees to 16 degrees.

20. A wedge in accordance with claim 17 wherein said wedge is fabricated from at least one of stainless steel, nylon, brass, and aluminum.

21. A method for securing a propshaft housing in a gear case bore with a wedge, the wedge including a flange having an opening therein, the propshaft housing including at least one web having an opening therein, said method comprising the steps of:

inserting the propshaft housing into the bore;

aligning the openings of the wedge and the web;

extending an attachment member through the aligned openings; and securing the wedge to the attachment member so that a portion of the wedge extends between the housing and an inner diameter surface of the bore.

22. A method in accordance with claim 21 further comprising the step of securing at least one retention tab to the propshaft housing so that the tab extends into contact with the bore inner diameter surface, prior to securing the wedge.

23. A method for securing a propshaft housing in a gear case bore, the housing including a center cylindrical shaped member, a positioning ring, and a plurality of webs extending from the center member to the positioning ring, said method comprising the steps of:

inserting the propshaft housing into the bore;

securing first and second retention tabs to opposing webs of the propshaft housing; and securing at least one wedge between the housing and an inner diameter surface of the bore.

24. A method in accordance with claim 23 wherein the wedge includes a flange having an opening therein, and the propshaft housing includes at least one web having an opening therein, and securing the wedge between the housing and an inner diameter surface of the bore comprises the steps of extending a bolt through aligned openings in the wedge and in the web, and tightening the bolt.

25. An outboard engine comprising a power head, an exhaust housing extending downward from said power head, and a lower unit extending downward from said exhaust housing, said lower unit comprising a gear case comprising a bore, a propshaft housing comprising a center cylindrical shaped member, and a positioning ring secured said center member by a plurality of webs, said ring having an outer diameter less than an inner diameter of the gear case bore, and a wedge for being secured to said propshaft housing and comprising a first portion configured to extend between the propshaft housing and an inner surface of the gear case bore and a second portion extending substantially perpendicular to said inner surface of the gear case bore.

26. A outboard engine in accordance with claim 25 wherein said propshaft housing positioning ring comprises a ramped surface, and said wedge is secured to said positioning ring at said ramped surface.

27. An outboard engine in accordance with claim 25 further comprising at least one retention tab for being secured to said propshaft housing and configured to engage a surface of said gear case to limit movement of said propshaft housing.

28. An outboard engine in accordance with claim 25 wherein said wedge comprises a flange and a wedge portion.

29. An outboard engine in accordance with claim 28 wherein said wedge portion comprises surfaces extending from each other at a selected angle A.

30. An outboard engine in accordance with claim 29 wherein angle A is in a range between about 10 degrees to 16 degrees.

31. An outboard engine in accordance with claim 25 wherein said wedge is fabricated from at least one of stainless steel, nylon, brass, and aluminum.

32. A propshaft housing assembly for being secured within a gear case of an engine, the gear case including a bore, said assembly comprising:

a propshaft housing comprising a center cylindrical shaped member, and a positioning ring secured to said center member by a plurality of webs, said ring having an outer diameter less than an inner diameter of the gear case bore;

a wedge for being secured to said propshaft housing and configured to extend between said propshaft housing and an inner surface of the gear case bore; and at least two retention tabs for being secured to opposing webs of said propshaft housing and configured to engage a surface of said gear case to limit movement of said propshaft housing.

33. A propshaft housing assembly for being secured within a gear case of an engine, the gear case including a bore, said assembly comprising:

a propshaft housing comprising a center cylindrical shaped member, and a positioning ring secured to said center member by a plurality of webs, said ring having an outer diameter less than an inner diameter of the gear case bore;

a wedge for being secured to said propshaft housing and configured to extend between said propshaft housing and an inner surface of the gear case bore; and another wedge for being secured to said positioning ring at one of said other webs.

* * * * *